US006679164B2

(12) United States Patent
Futamura et al.

(10) Patent No.: US 6,679,164 B2
(45) Date of Patent: Jan. 20, 2004

(54) PRESS MACHINE

(75) Inventors: Shoji Futamura, Atsugi (JP); Hiromitsu Kaneko, Atsugi (JP)

(73) Assignee: Institute of Technology Precision Electrical Discharge Work's, Kanagawa (JP)

( * ) Notice: Subject to any disclaimer, the term of this patent is extended or adjusted under 35 U.S.C. 154(b) by 0 days.

(21) Appl. No.: 10/148,146

(22) PCT Filed: Oct. 16, 2001

(86) PCT No.: PCT/JP01/09056

§ 371 (c)(1),
(2), (4) Date: May 23, 2002

(87) PCT Pub. No.: WO02/38366

PCT Pub. Date: May 16, 2002

(65) Prior Publication Data

US 2002/0178938 A1 Dec. 5, 2002

(30) Foreign Application Priority Data

Nov. 7, 2000 (JP) ..... 2000-339304

(51) Int. Cl.[7] ..... B30B 1/40

(52) U.S. Cl. ..... 100/291; 100/230; 100/289; 100/257

(58) Field of Search ..... 100/274, 276, 100/291, 230, 257, 289, 214

(56) References Cited

U.S. PATENT DOCUMENTS 3,376,728 A * 4/1968 Nemessanyi ..... 72/454
3,584,497 A * 6/1971 Pohjola ..... 72/448
4,354,374 A * 10/1982 Deguchi ..... 72/389.5
4,959,989 A * 10/1990 Obrecht et al. ..... 72/450
5,746,122 A * 5/1998 Gietz et al. ..... 100/43
5,891,281 A * 4/1999 Giordano et al. ..... 156/64

FOREIGN PATENT DOCUMENTS

| | | |
|---|---|---|
| JP | SHO-61 143799 | 9/1986 |
| JP | 1-241396 | 9/1989 |
| JP | 5-245696 | 9/1993 |
| JP | 6-218591 | 8/1994 |
| JP | 2000-218395 | 8/2000 |

* cited by examiner

*Primary Examiner*—Allen Ostrager
*Assistant Examiner*—Shelley M Self
(74) *Attorney, Agent, or Firm*—McGlew and Tuttle, P.C.

(57) ABSTRACT

A press machine comprising a base, a guide member provided in such a manner that an end thereof orthogonally intersects the base, a support plate provided in such a manner that the other end of the guide member orthogonally intersects the guide member, a screw shaft supported by the support plate in parallel with the guide member, a nut member engaging with the screw shaft, and a movable body; the movable body consisting of a first movable body and a second movable body, both facing each other, obtained by dividing the movable body at a surface intersecting the traveling direction of the movable body; the first and second movable bodies connecting each other via a differential member formed in such a manner as to slidably engage with the first and second movable bodies; the differential member formed in such a manner as to be movable in a direction orthogonally intersecting the traveling direction of the movable body; and the first and second movable bodies adapted to be relatively movable along the traveling direction of the movable body along with the movement of the differential member.

19 Claims, 5 Drawing Sheets

PRESS MACHINE

TECHNICAL FIELD

The present invention relates generally to a press machine for use in sheet metal working, for example, and more particularly to a press machine having a simple construction and capable of fixed-stroke press operation requiring precise positional control.

BACKGROUND ART

Fluid pressure cylinders have heretofore been widely used as means for driving a ram that comes into contact with a workpiece in a press machine. As such fluid pressure cylinders, hydraulic (or oil pressure) cylinders have been commonly used. When a fixed-stroke press operation, that is, a press operation in a state where the distance between the ram and the table is kept constant, is carried out in such a press machine driven by a hydraulic cylinder, a press operation called the "Do-zuki press operation" is usually needed.

FIG. 6 is a diagram of assistance in explaining the conventional "Do-zuki press operation." In FIG. 6, numeral 31 refers to a table, on which a ram 32 of a press machine is operated vertically with a hydraulic cylinder to press a workpiece 33.

In order to precisely press the workpiece 33 to a thickness t in this arrangement, a projection 35 equal to the thickness t is provided on the lower end of the ram 32 downward from the working surface 34.

When the ram 32 is operated downward with the aforementioned construction, the working surface 34 can perform a desired work on the workpiece 33, and the thickness t of the workpiece 33 can be maintained with precision since the projection 35 of the ram 32 comes in contact with the table 31, resulting in a press operation without dimensional variations. This leads to an improved working accuracy.

The press operation as shown in FIG. 6 above has the following problems, though press working accuracy can be improved with the fixed-stroke press operation. That is, not only the ram 32 violently hits against the workpiece 33, but also the projection 35 of the ram 32 also violently hits against the table 31, generating impact noises. Particularly greater noises are generated during high-speed press operations involving high frequencies of ram reciprocation.

Fixed-stroke press operation with electrically operated press machines has heretofore been commonly used, which has recently been enjoying popularity due to its advantage in effectively preventing noises generated in the so-called Do-zuki press operation with hydraulic press machines.

FIG. 7 is a longitudinal sectional view of a typical electric-powered press machine of a conventional type, as disclosed in Japanese Published Unexamined Patent Application No. Hei-6(1994)-218591.

In FIG. 7, numeral 41 refers to pressure generating means that is housed in a top frame member 44 provided on a column 43 integrally formed with a table 42.

Numeral 45 refers to a cylindrical body provided in the top frame member 44 and having a bearing 46 on the upper end thereof. Numeral 47 refers to a screw shaft formed in a suspended state with the top end thereof supported by the bearing 46.

Next, numeral 48 refers to a ram shaft formed into a hollow cylindrical shape, with a nut 49 engaging with the screw shaft 47 fixedly fitted to the upper end thereof, and provided vertically movably in the cylindrical body 45.

Numeral 50 refers to a pushing member provided detachably on the lower end of the ram shaft 48. The screw shaft 47 and the nut 49 form a ball screw engagement.

Next, numeral 51 refers to an anti-vibration device comprising a guide 52 provided in the top frame member 44, an anti-vibration bar 53 vertically movably provided in the guide 52, and a connecting plate 54 provided on the lower ends of the ram shaft 48 and the anti-vibration bar 53. Numeral 55 refers to a drive motor provided in the top frame member 44 to drive the screw shaft 47 in forward and backward rotations via a pulley 56 and a belt 57 provided on the upper end of the screw shaft 47.

Furthermore, measuring means, central processing unit (not shown), etc. are provided so as to control the settings of the initial start position and the fixed stop position of the pushing member 50, as well as the rotational speed and the forward/backward rotation of the drive motor 55.

With the aforementioned construction, when the drive motor 55 is operated to cause the screw shaft 47 to rotate via the belt 57 and the pulley 56, the ram shaft 48 to the upper end of which the nut 49 is fixedly fitted is lowered, bringing the pushing member 50 into contact with the workpiece W at a predetermined position as shown by chain double-dashed lines in the figure and with a predetermined pushing force to carry out a predetermined press operation.

Upon completion of the press operation, the drive motor 55 is rotated in the reverse direction to lift the ram shaft 48 and the pushing member 50 back to the initial position. By repeating the above operations, predetermined fixed-stroke press operations can be performed sequentially on a plurality of the workpieces W.

With an electric-powered press machine having the aforementioned construction, fixed-stroke press operation can be accomplished without generating harsh noises. The conventional types of electric-powered press machines, however, have the following problems. That is, the height h of the lower end surface of the pushing member 50 from the table 42 in FIG. 7 is controlled to be kept constant at any time, as needed in fixed-stroke press operation, and therefore a predetermined pushing force is applied to the workpiece W via the pushing member 50 at that position. In other words, a reaction force equal to the abovementioned pushing force is exerted onto the screw shaft 47 and the nut 49 always at the same relative positions.

The screw shaft 47 and the nut 49, on the other hand, constitutes a ball screw engagement to ensure high-precision positional control of the ram shaft 48 and the pushing member 50, in which balls and ball grooves constituting a ball screw engage with each other in line or point contact. For this reason, when the aforementioned reaction force acts on both the balls and the ball grooves many times at the same relative position, the balls and/or the ball grooves could be locally worn out, leading to lowered working accuracy and reduced service life. Even in cases where the aforementioned screw shaft 47 and the nut 49 constitute a normal screw engagement, the aforementioned local wear problem may persist.

To solve the aforementioned problem, the present applicant has already filed a patent application (Japanese Unexamined Published Patent Application No. Hei-11(1999)-23483) for an invention comprising a base formed into a flat plate shape, a guide bar provided on the base in such a manner that an end of the guide bar orthogonally intersects the base, a support plate formed into a flat plate shape provided at the other end of the guide bar in such a manner as to orthogonally intersect the guide bar, a screw shaft supported by the guide bar in parallel with the guide bar in such a manner as to be rotatable in forward and backward directions, a movable body axially movably engaged with the guide bar, a nut member formed into a hollow cylindrical shape, having a differential male thread on the outer surface thereof, in such a manner as to engage with the screw shaft, a differential member formed into a hollow cylindrical shape, having a differential female thread for engaging with the differential male thread, and formed rotatably in the movable body, and a worm wheel fixedly fitted to the differential member for engaging a worm.

FIG. 4 is a longitudinal sectional front view illustrating essential parts of a typical improved invention, and FIG. 5 is a cross-sectional view taken along line A—A in FIG. 4.

In FIGS. 4 and 5, numeral 1 refers to a base formed into a shape of a rectangular flat plate, for example, on the four corners of which provided upright are columnar guide bars 2. To the upper ends of the guide bars 2 fixedly fitted via fastening members 4, for example, is a support plate 3 formed into a shape of a rectangular flat plate, for example.

Next, numeral 5 refers to a screw shaft supported via a bearing member 6 at the center of the support plate 3, passing through the support plate 3, in such a manner as to be rotatable in forward and backward directions. Numeral 7 refers to a movable body engaged with the guide bars in such a manner as to be movable in the axial direction of the guide bars 2. Numeral 8 refers to a nut member formed by integrally combining a nut 10 having a flange 9 and a cylinder part 11 formed into a hollow cylindrical shape. The nut 10 is engaged with the screw shaft 5 through a ball screw engagement, and a differential male thread 13 is provided on the outer peripheral surface of the cylinder part 11.

Numeral 14 refers to a differential member formed into a hollow cylindrical shape and having on the inner peripheral surface a differential female thread for engaging with the above differential male thread 13. Numeral 16 refers to a worm wheel fixedly fitted integrally to the differential member 14 for engaging with the worm 17. Numerals 18 and 19 refer to a radial bearing and a thrust bearing, respectively, provided in the movable body 7 for supporting the differential member 14 and the worm wheel 16.

Numeral 20 refers to a worm shaft passed though and fixedly fitted to the center of the worm 17, with both ends thereof rotatably supported by bearings 21 and 21 provided in the movable body 7. Numerals 22 and 23 refer to pulse or servo motors for rotating the screw shaft 5 and the worm shaft 20. Numeral 24 refers to a pushing member detachably provided on the lower central surface of the movable body 7. The pulse motors 22 and 23 have such a construction that the operation of the pulse motors can be controlled as predetermined pulses are applied via a control unit (not shown).

With the above construction, as the pulse motor 22 is operated upon application of a predetermined number of pulses, the screw shaft 5 is rotated, lowering the movable body having the nut member 8. The pushing member 24 is then lowered from the initial height $H_0$ to a fixed-stroke pressing height H, coming into contact with the workpiece W. As a result, the fixed-stroke press operation on the workpiece W is carried out with a predetermined pushing force via the pushing member 24.

Upon completion of press operation, the pulse motor 22 is reversed, lifting the movable body 7 and returning the pushing member 24 to the position of the initial height $H_0$. The $H_0$ and H values mentioned above are such that they are measured by measuring means (not shown) and can be controlled in conjunction with the pulse motor 22.

As the aforementioned fixed-stroke press operation reaches a predetermined number of times, the operation of the pulse motor 22 is stopped at the position shown in FIG. 4, that is, the position of the initial height $H_0$ of the pushing member 24, and a predetermined number of pulses are applied to the pulse motor 23. With this, the pulse motor 23 rotates by a predetermined number of turns, causing the differential member 14 to rotate to a predetermined central angle via the worm shaft 20, the worm 17 and the worm wheel 16. With the rotation of the differential member 14, the differential female thread 15 rotates with respect to the differential male thread 13, and as a result, the movable body 7 is moved from the state where the nut member 8 has been stopped and locked.

With the movement of the movable body 7, the initial height $H_0$ of the pushing member 24 changes, so the predetermined fixed-stroke press operation cannot be accomplished if the screw shaft 5 is rotated as it is. For this reason, the screw shaft 5 is finely rotated by applying a certain controlled number of pulses to the pulse motor 22, offsetting the movement of the movable body 7 and the pushing member 24 to keep the initial height $H_0$ of the pushing member 24 constant.

With the rotation of the screw shaft 5, the relative positions of the screw shaft 5 and the nut 10 change. That is, the relative positions of the screw shaft 5 and the nut 10 formed into a ball screw engagement can be changed, and therefore the local wear of the balls and/or the ball grooves can be prevented while maintaining the fixed-stroke press operation. After the corrective operation as described above has been carried out, the aforementioned fixed-stroke press operation is resumed.

Although the improved invention can maintain the fixed-stroke press operation and prevent the unwanted local wear of the balls and/or ball grooves constituting the ball-screw engagement, it is found that the improved invention has several problems.

That is, the differential member 14 provided in the movable body 7 must be minutely rotated in the improved invention in order to correct the movement of the movable body 7 and keep the initial height $H_0$ of the pushing member 24 in the non-operating state constant. To achieve this, the worm 17 and the worm wheel 16 as means for rotating the differential member 14 must be manufactured. This could result in troublesome and expensive manufacturing operations. Furthermore, the manufacture of the differential male thread 13 and the differential female thread 15 could be troublesome and expensive. The construction of the entire system could be complicated and large in size.

The present invention has been invented to solve these problems inherent in the prior art. It is an object of the present invention to provide a press machine for fixed-stroke press operation that is simple in construction and easy to manufacture.

DISCLOSURE OF THE INVENTION

To solve these problems, the press machine according to the present invention comprises a base, a guide member provided in such a manner that an end of the guide member orthogonally intersects the base, a support plate provided at the other end of the guide member in such a manner as to orthogonally intersect the guide member, a screw shaft supported by the support plate in parallel with the guide member, a nut member for engaging with the screw shaft, and a movable body; the movable body comprising a first movable body and a second movable body divided by a plane intersecting the traveling direction of the movable body and disposed facing each other; the first and second movable bodies connected via a differential member formed in such a manner as to be slidably engaged with the first and second movable bodies; the differential member movably formed in the direction orthogonally intersecting the traveling direction of the movable body; and the first and second movable bodies made relatively movable with each other along the traveling direction of the movable body as the differential member moves.

In the press machine according to the present invention, a pair of guide plates can be provided on both side surfaces of the first and second movable bodies in such a manner as to slidably engage with the first and second movable bodies, so that the movement of the first and second movable bodies in the direction orthogonally intersecting the direction of the relative movement thereof can be constrained.

In the press machine according to the present invention, the base and the support plate can be disposed in parallel with the horizontal plane, and the axial line of the guide member can be disposed vertically.

In the press machine according to the present invention, the screw shaft and the nut member can be formed as a ball-screw engagement.

With such a construction, the movement of the movable body can be made smooth, and the positional accuracy thereof can be improved.

In the press machine according to the present invention, the screw shaft and/or the differential member can be constructed so that they can be driven by a pulse or servo motor.

In the press machine according to the present invention, the displacement of the movable body along with the movement of the differential member can be offset by the relative rotation of the screw shaft and the nut member so that the distance between the base and the movable body in the non-operating state of the movable body can be kept constant.

In the press machine according to the present invention having the aforementioned construction, when a pulse motor is operated by applying a predetermined number of pulses, the screw shaft is rotated, the movable body comprising the first movable body, the second movable body and the differential member connecting these movable bodies is lowered, and the pushing member of the movable body is lowered from the initial height $H_0$ to the fixed-stroke press operation height H. Thus, a fixed-stroke press operation is carried out on the workpiece. Upon completion of the fixed-stroke press operation, the movable body is lifted by the operation of the pulse motor in the reverse direction, and the pushing member of the movable body is returned to the initial height $H_0$.

When the aforementioned fixed-stroke press operation reaches a predetermined number of times, or every time the fixed-stroke press operation is carried out, the position of the movable body is changed as the first movable body and the second movable body are caused to be relatively moved vertically by stopping the operation of the pulse motor at the location of the initial height $H_0$ of the pushing member and causing the differential member to finely move horizontally. Then, a corrective operation is performed to offset this displacement of the movable body, keeping the initial height $H_0$ of the pushing member constant.

With the rotation of the screw shaft associated with the aforementioned corrective operation, the relative positions of the screw shaft and the nut member change. That is, the relative positions of the balls and the ball grooves constituting the ball-screw engagement also change. Thus, the local wear of the balls and/or the ball grooves can be prevented while maintaining the fixed-stroke press operation.

BEST MODE FOR CARRYING OUT THE INVENTION

Figure 1:
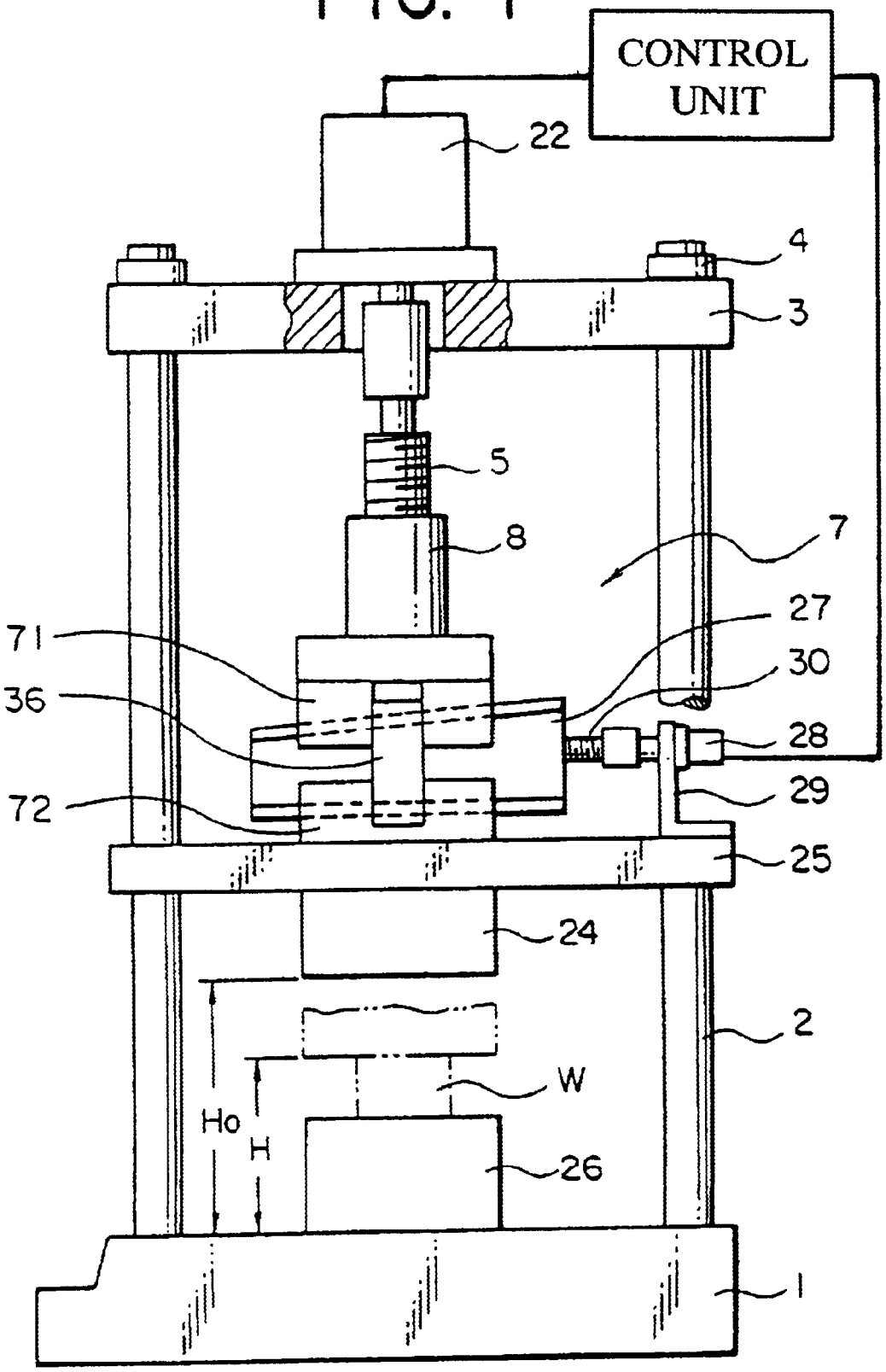
FIG. 1 is a longitudinal sectional front view showing the essential part of an embodiment of the present invention.
Figure 4:
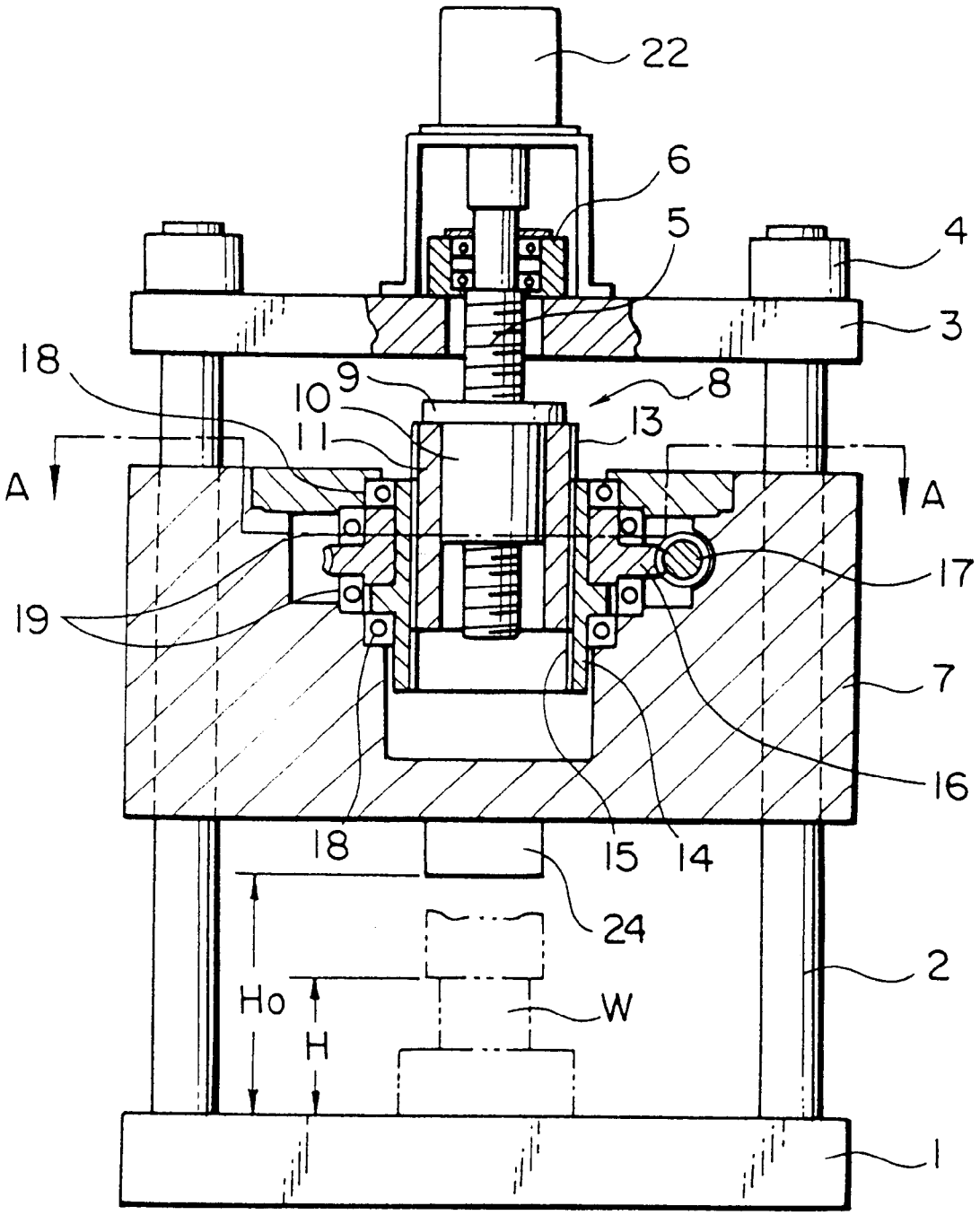
FIG. 4 is a longitudinal sectional front view showing an improved invention.
Figure 5:
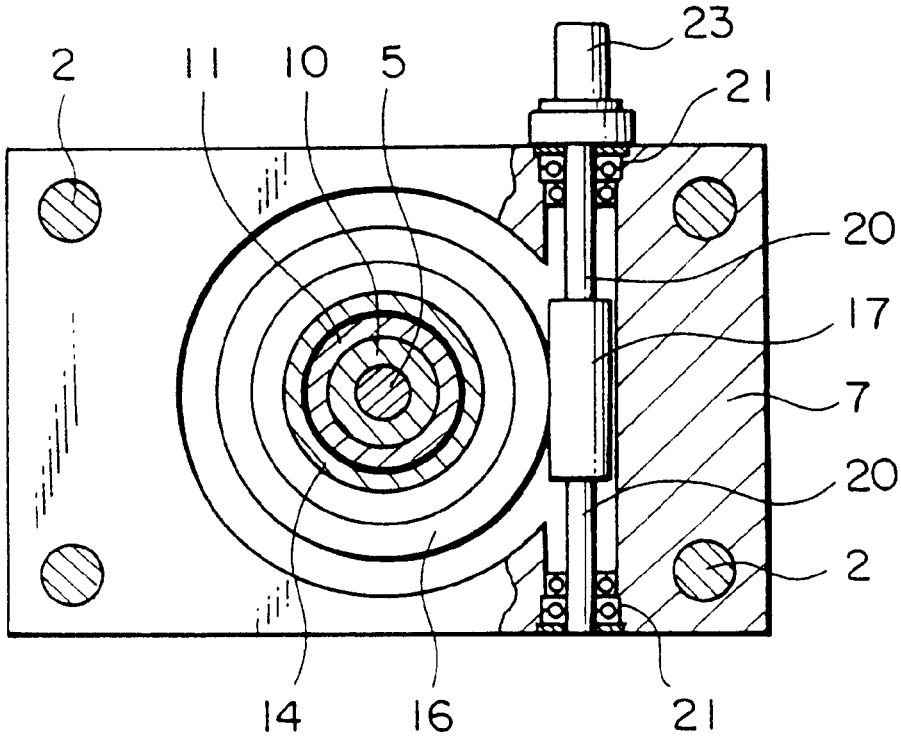
FIG. 5 is a cross-sectional plan view taken along line A—A in FIG. 4.
Figure 6:
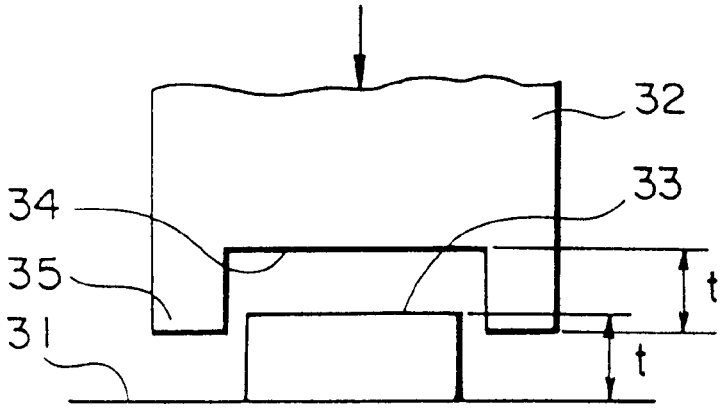
FIG. 6 is a diagram of assistance in explaining the conventional "Do-zuki" press operation.
Figure 7:
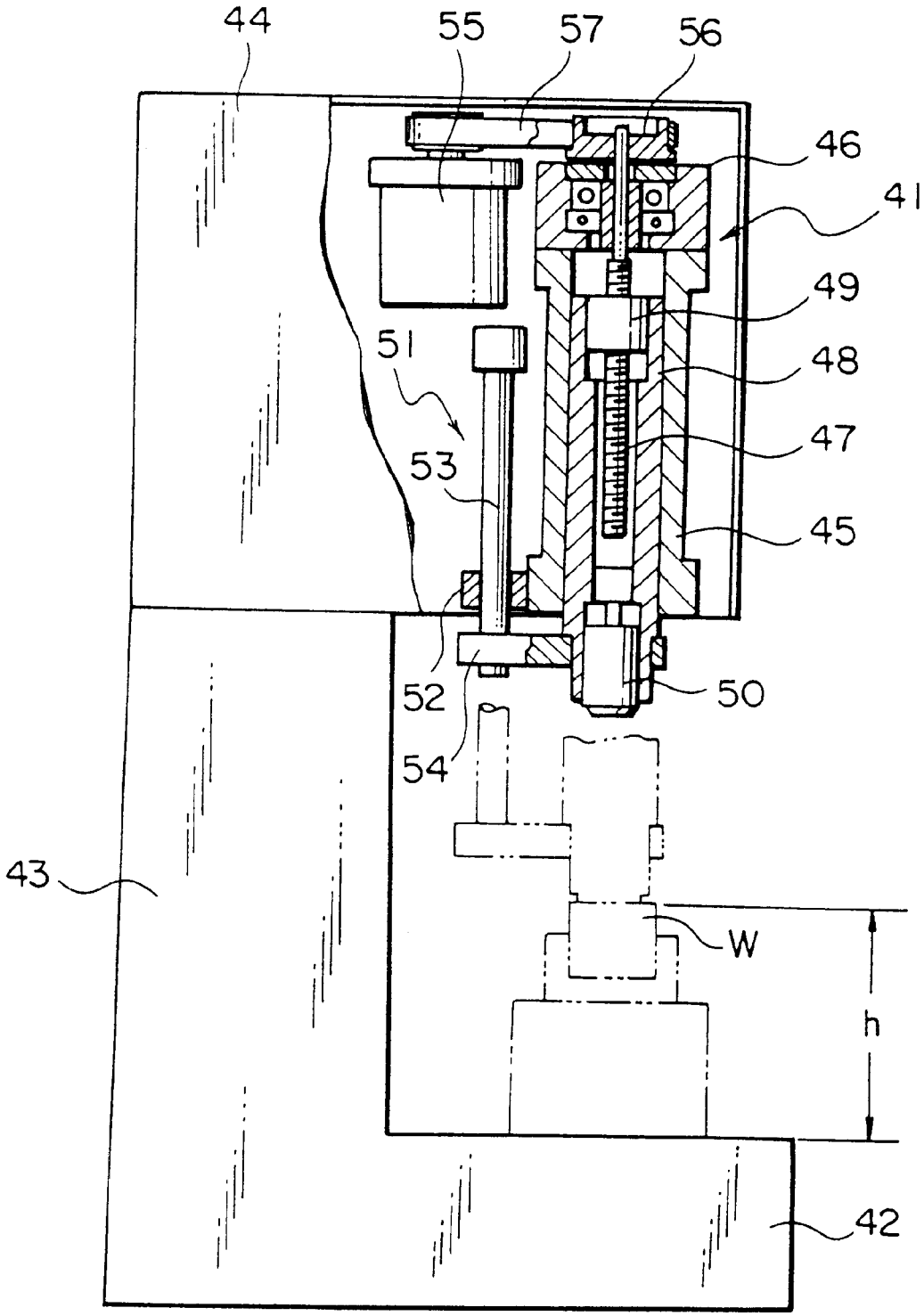
FIG. 7 is a longitudinal sectional view showing an example of an electric-powered press of a conventional type.

FIG. 1 is a longitudinal sectional front view showing the essential part of an embodiment of the present invention, and like parts are indicated by like reference numerals used in FIGS. 4 and 5 above.

In FIG. 1, numeral 25 refers to a slide plate that is in sliding contact with a guide body (also referred to as a guide bar) and vertically movably provided. A pushing member 24 is fixedly fitted to the lower part of the slide plate 25. Numeral 26 refers to a table provided on a base 1 for supporting a workpiece W.

Next, a movable body 7 is divided on a plane intersecting the traveling direction (the vertical direction in FIG. 1) of the movable body 7, or on a horizontal plane, for example, and comprises a first movable body 71 and a second movable body 72, both facing each other. The first movable body 71 is fixedly fitted to a nut member 8 and the second movable body 72 to the slide plate 25, respectively. Numeral 27 refers to a differential member formed into a wedge, as will be described later, that connects the first and second movable bodies 71 and 72 and has functions as will be described later.

Numeral 28 refers to a pulse or servo motor provided on the slide plate 25 via a support member 29 for driving the differential member 27 in the direction orthogonally intersecting the traveling direction of the movable body 7 (the longitudinal direction in FIG. 1). That is, a screw shaft 30 is connected to the main shaft of the pulse motor 28, and the screw shaft 30 is adapted to engage with a nut member (not shown) provided in the differential member 27. Numeral 36 refers to a guide plate; a pair of the guide plates 36 being provided on both side surfaces of the first and second movable bodies 71 and 72, for example, with the lower ends thereof fixedly fitted to the second movable body 72 and the neighborhood of the upper ends thereof formed in such a manner as to slidably engage with the first movable body 71.

Figure 2:
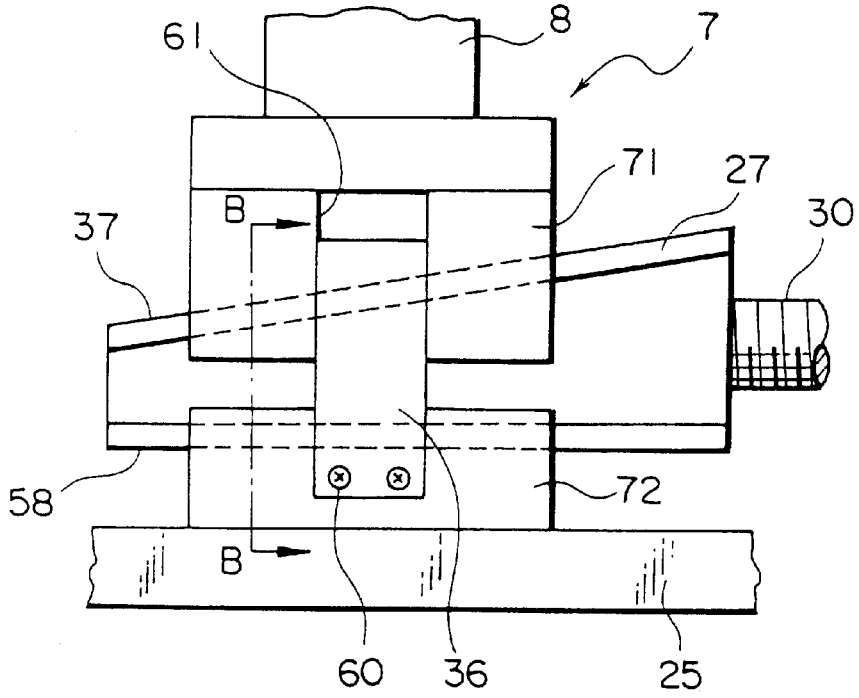
FIG. 2 is an enlarged front view showing a differential member in FIG. 1 and the vicinity thereof.
Figure 3:
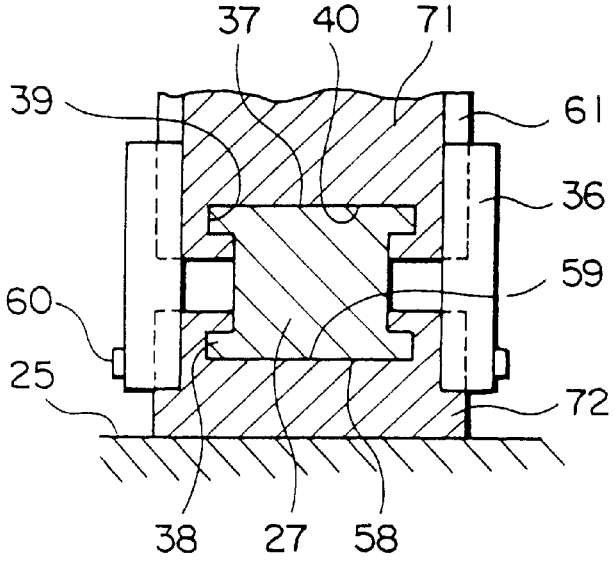
FIG. 3 is a cross-sectional view taken along line B—B in FIG. 2.

FIG. 2 is an enlarged front view showing a differential member in FIG. 1 and the vicinity thereof. FIG. 3 is a cross-sectional view taken along line B—B in FIG. 2, and like parts are indicated by like numerals used in FIG. 1.

In FIGS. 2 and 3, the differential member 27 is formed into an I shape in cross section, and in such a manner as to have an inclined surface 37 in the longitudinal direction thereof.

Protruded ridges 38 integrally formed with the side surface of the differential member 27 are formed in such a manner as to slidably engage with grooves 39 provided on the first and second movable bodies 71 and 72. The inclined surface 37 constituting the top surface of the differential member 27 engages with an inclined surface 40 formed in the first movable body 71 at the same inclination angle as that of the inclined surface 37, and a bottom surface 58 of the differential member 27 slidably engages with a horizontal support surface 59 provided in the second movable body 72. An upper half of the guide plate 36 provided on the second movable body 72 via a mounting member 60 slidably engages with a guide groove 61 provided on the side surface of the first movable body 71.

With the aforementioned construction, when the pulse or servo motor 22 is operated by a control unit applying a predetermined number of pulses to the pulse motor 22, the screw shaft 5 is rotated, lowering the movable body 7 comprising the first and second movable bodies 71 and 72 and the differential member 27 connecting them. Then, the pushing member 24 similar to that shown in FIG. 4 above lowers from the initial height $H_0$ to the fixed-stroke press operation height H, and the fixed-stroke press operation is carried out on the workpiece W. Upon completion of the press operation, the movable body 7 is lifted by the control unit operating the pulse motor 22 in the reverse direction, and the pushing member 24 is returned to the initial height $H_0$. The measurement of the H values and the control of the pulse motor 22 are similar to those shown in FIG. 1.

When the aforementioned fixed-stroke press operation reaches a predetermined number of times, or every time the fixed-stroke press operation is carried out, the operation of the pulse motor is stopped at the position of the initial height $H_0$ of the pushing member 24, and a predetermined number of pulses are applied to the pulse motor 28. This causes the pulse motor 28 to rotate by a predetermined number of turns, and the differential member 27 is finely moved horizontally via the screw shaft 30. With the movement of the differential member 27, the first and second movable bodies 71 and 72 are vertically moved relatively, and the movable body 7 is displaced. The corrective operation to offset this displacement is carried out and the initial height $H_0$ of the pushing member 24 is kept constant by applying a certain number of pulses to the pulse motor 22, as in the case of FIG. 1.

Since the relative positions of the balls and the ball grooves constituting the ball-screw engagement can be changed by rotating the screw shaft 5 along with the aforementioned corrective operation to change the relative positions of the screw shaft 5 and the nut member 8, the local wear of the balls and/or the ball grooves can be prevented while maintaining the fixed-stroke press operation, and therefore the fixed-stroke press operation can be repeated in subsequent operations.

In the aforementioned embodiment of the present invention, description has been made on the so-called vertical type where the base 1 and the support plate 3 are disposed in parallel with the horizontal plane, with the guide bar 2 connecting both provided vertically. The present invention can also be applied to the so-called horizontal type where the base 1 and the support plate 3 are disposed in parallel with the vertical plane, with the guide bar 2 provided horizontally.

Although the present invention is especially effective for a ball-screw engagement comprising the screw shaft 5 and the nut member 8, the present invention can also be applied to a normal screw engagement. That is, the similar effect of preventing the local wear caused by the application of a reaction force corresponding to the pushing force during press operation only onto a particular portion of the screw and extending the service life of the screw can be expected from the present invention. Needless to say, multi-thread screws can be used for the screw engagement or the ball-screw engagement in the present invention.

Although the most common type of the pulse motors 22 and 28 for driving the screw shaft 5 and the differential member 27 is such that the pulse motor is coaxially connected directly to these shaft, the use of gears, timing belts and other transmission means may be used to transmit the drive power. Furthermore, the screw shaft 30 may be of such a construction that it can be rotated manually, or that control can be accomplished by reflecting the information on the revolution of the screw shaft 30 to the number of pulses of the pulse motor 22 required for corrective operation.

For larger, heavy-duty types of press machines requiring rigidity, moreover, a plurality of guide bars 2 for guiding the movement of the movable body 7 should preferably be used. A single guide bar, however, may of course serve the purpose, and that of a columnar or beam shape over which the movable body 7 can be slide may be used in some cases.

Furthermore, the press machine according to the present invention can be applied not only to a stand-alone press machine but also to a plurality of press machines arranged in tandem for index-feed press operation on long-sized workpieces. The press machine according to the present invention can be used not only for sheet metal working on sheet materials but also for assembly, press-fitting, staking, etc. of a plurality of parts, and for mold clamping in injection molding machines, die-cast machine, power metallurgy, etc.

Industrial Applicability

As described above, the present invention makes it possible

1) To manufacture a press machine having a simple construction, make the manufacture easy, and reduce the size of the machine.
2) To prevent the local wear of machine components, extending the service of the machine even after repeated fixed -stroke press operations since the relative positions of the screw shaft and the nut member for exerting pressure can be changed appropriately.
3) To achieve highly efficient production because the aforementioned operation of changing the relative positions of the components can be performed with extreme ease and in a short period of time, leading to high ratio of actual press working hours.
4) To improve machining accuracy because the stop position of the lower end of the movable body can be accurately controlled.
5) To ensure quite working environment because noises encountered with hydraulic driven machines can be eliminated.

What is claimed is:

1. A press machine comprising:

a base with a table surface for supporting a workpiece;

a guide member having one end connected to said base;

a support plate connected to another end of said guide member;

ball screw arrangement having screw shaft, a nut member and a plurality of balls between said screw shaft and said nut member;

a slide plate being movable in a pressing direction toward and away from said base;

said support plate rotatably connected to said screw shaft of said ball screw arrangement;

a movable device adjusting a distance between said slide plate and said table surface in said pressing direction, said movable device includes a first movable body and a second movable body, said movable device includes a differential member arranged between, and slidably engaging with, said first and second movable bodies, said differential member being movable in an adjusting direction substantially orthogonal to said pressing direction, said first and second movable bodies and said differential member being shaped to have movement of said differential member with respect to said first and second movable bodies cause said first and second movable bodies to expand and contract in said pressing direction, expanding and contracting of said movable bodies adjusting said distance in said pressing direction between said slide plate and said table surface;

a press motor connected to said screw shaft and rotatable of said screw shaft;

an adjustment motor connected to said differential member and movable of said differential member in said adjusting direction;

a control unit controlling said press motor to move said slide plate between a first and second position with respect to said table surface, said control unit also controlling said adjustment motor to move said differential member, said control unit adjusting operation of said pressing motor to maintain said slide plate moving between said first and second positions so that said distance between said first and second positions is kept constant after said adjustment motor moves said differential member.

2. A press machine as set forth in claim 1 wherein a pair of guide plates are provided on both side surfaces of the first and second movable bodies in such a manner as to slidably engage with the first and second movable bodies so that the movement of the first and second movable bodies in the direction orthogonally intersecting the direction of relative movement of the first and second movable bodies can be constrained.

3. A press machine as set forth in claim 1 wherein the base and the support plate are disposed in parallel with a horizontal plane, and an axial line of the guide member is disposed vertically.

4. A press machine as set forth in claim 1 wherein the screw shaft and/or the differential member are driven by a pulse motor.

5. A press machine in accordance with claim 1, wherein:

said movable device is arranged between said screw shaft and said slide plate.

6. A press machine in accordance with claim 1, wherein:

said control unit operates said adjustment motor after a predetermined number of movements of said slide plate between said first and second positions.

7. A press machine in accordance with claim 1, wherein:

said control unit operates said adjustment motor to substantially evenly wear said ball screw arrangement from movements of said slide plate between said first and second positions.

8. A press machine in accordance with claim 1, wherein:

said ball screw arrangement includes a ball groove on said screw shaft and a plurality of balls arranged in said ball groove.

9. A method for operating a press machine, the method comprising the steps of:

providing a base with a table surface for supporting a workpiece;

providing a guide member having one end connected to said base;

providing a support plate connected to another end of said guide member;

providing a screw shaft rotatably connected to said support plate;

providing a slide plate rotatably connected to said screw shaft with a ball screw arrangement, said ball screw arrangement having rotation of said screw shaft cause movement of said slide plate in a pressing direction toward and away from said base;

providing a movable device adjusting a distance between said slide plate and said table surface in said pressing direction, said movable device includes a first movable body and a second movable body, said movable device includes a differential member arranged between, and slidably engaging with, said first and second movable bodies, said differential member being movable in an adjusting direction substantially orthogonal to said pressing direction, said first and second movable bodies and said differential member being shaped to have movement of said differential member with respect to said first and second movable bodies cause said first and second bodies to expand and contract in said pressing direction, expanding and contracting of said movable bodies adjusting said distance in said pressing direction between said slide plate and said table surface;

rotating said screw shaft to repetitively move said slide plate between a first and second position with respect to said table surface;

moving said differential member to expand and contract said movable device;

adjusting said rotating of said screw shaft to maintain said slide plate moving between said first and second position after said moving of said differential member.

10. A method in accordance with claim 9, wherein:

said moving of said differential member is performed after a predetermined number of movements of said slide plate between said first and second positions.

11. A method in accordance with claim 9, wherein:

said moving of said differential member is performed to substantially evenly wear said ball screw arrangement as occurring due to movements of said slide plate between said first and second positions.

12. A method in accordance with claim 9, wherein said moving of said differential member is performed after every movement of said said slide plate from said first position to said second position, and back to said first position.

13. A press machine in accordance with claim 1, wherein:

said control unit operates said adjustment motor each time said slide plate moves from said first position to said second position and back to said first position.

14. A press machine in accordance with claim 1, wherein:

said first movable body is unrotatably connected to said nut member and said second movable body is unrotatably connected to said slide plate.

15. A press machine comprising:

a base with a table surface for supporting a workpiece;

a guide member having one end connected to said base;

a support plate connected to another end of said guide member;

a screw shaft rotatably connected to said support plate;

a slide plate rotatably connected to said screw shaft with a ball screw arrangement, said ball screw arrangement having rotation of said screw shaft cause movement of said slide plate in a pressing direction toward and away from said base;

a movable device adjusting a distance between said slide plate and said table surface in said pressing direction, said movable device includes a first movable body and a second movable body, said movable device includes a differential member arranged between, and slidably engaging with, said first and second movable bodies, said differential member being movable in an adjusting direction substantially orthogonal to said pressing direction, said first and second movable bodies and said differential member being shaped to have movement of said differential member with respect to said first and second movable bodies cause said first and second bodies to expand and contract in said pressing direction, expanding and contracting of said movable bodies adjusting said distance in said pressing direction between said slide plate and said table surface;

a press motor connected to said screw shaft and rotatable of said screw shaft;

an adjustment motor connected to said differential member and movable of said differential member in said adjusting direction;

a control unit controlling said press motor to move said slide plate between first and second distances from said table surface, said control unit also controlling said adjustment motor to move said differential member, said control unit adjusting operation of said pressing motor to maintain said slide plate moving between said first and second distances from said table surface when said adjustment motor moves said differential member.

16. A press machine in accordance with claim 15, wherein:

said movable device is connected on one side to said screw shaft and connected on an opposite side to said slide plate.

17. A press machine in accordance with claim 15, wherein:

said control unit operates said adjustment motor after a predetermined number of movements of said slide plate between said first and second distances.

18. A press machine in accordance with claim 15, wherein:

said control unit operates said adjustment motor to substantially evenly wear said ball screw arrangement from movements of said slide plate between said first and second distances.

19. A press machine in accordance with claim 15, wherein:

said ball screw arrangement includes a ball groove on said screw shaft and a plurality of balls arranged in said ball groove.

* * * * *